United States Patent [19]

Montabert

[11] 4,059,279

[45] Nov. 22, 1977

[54] HOLLOW PERCUSSION DRILL ROD WITH SEAL FOR CLEANING FLUID INLET TUBE

[76] Inventor: Roger Montabert, 19, Avenue des Colonnes, Bron (Rhone), France

[21] Appl. No.: 698,495

[22] Filed: June 22, 1976

[30] Foreign Application Priority Data

July 4, 1975 France ..... 75.21786

[51] Int. Cl.[2] ..... F16K 41/14; B25D 17/02; B25D 17/22

[52] U.S. Cl. ..... 277/166; 277/168; 173/78; 285/110; 279/20; 408/59

[58] Field of Search ..... 277/166, 168–172, 277/DIG. 9; 285/110; 181/33 A, 33 Q, 36 A; 173/78, DIG. 2; 279/20; 408/59

[56] References Cited

U.S. PATENT DOCUMENTS

| | | | |
|---|---|---|---|
| 2,164,886 | 7/1939 | Reufer | 173/78 |
| 2,506,069 | 5/1950 | Dalton | 285/110 X |
| 2,691,418 | 10/1954 | Connolly | 285/110 X |
| 2,725,214 | 11/1955 | Löfqvist | 173/78 |
| 2,790,624 | 4/1957 | Löfqvist et al. | 173/78 X |
| 2,997,024 | 8/1961 | McLean | 181/33 A X |
| 3,487,748 | 1/1970 | Grage | 408/59 X |
| 3,714,993 | 2/1973 | Nolley | 173/78 |
| 3,941,196 | 3/1976 | Curington et al. | 173/78 X |

FOREIGN PATENT DOCUMENTS

| | | | |
|---|---|---|---|
| 1,245,994 | 10/1960 | France | 173/78 |
| 154,523 | 5/1956 | Sweden | 173/78 |
| 251,686 | 5/1926 | United Kingdom | 173/78 |
| 950,730 | 2/1964 | United Kingdom | 173/78 |

*Primary Examiner*—Robert S. Ward, Jr.
*Attorney, Agent, or Firm*—Karl F. Ross

[57] ABSTRACT

A percussion drill in which a piston or ram is driven against the end of a drill rod comprises a tube extending through the piston and reaching into a bore at the end of the drill rod to deliver a fluid thereto for moving debris formed by the drilling operation. A socket is received in a bore of the drill rod and has a resilient lip which is deflected inwardly by the flared mouth of the drill rod bore while the tube has a tapered end which is engaged by the wall of a tapered bore formed in the socket.

7 Claims, 4 Drawing Figures

HOLLOW PERCUSSION DRILL ROD WITH SEAL FOR CLEANING FLUID INLET TUBE

This invention is concerned with improvements in or relating to percussion drills.

The drilling of blast holes with percussion machines requires the use of a fluid, generally water or air, for evacuating the rock debris produced by each impact. It is therefore necessary for this fluid to pass from the inlet to the drill rod constituting the boring tool. This drill rod is usually hollow for this purpose. Furthermore, its movement relative to the hammer is a complex rotary one involving alternating axial movements at the frequency of the impacts. An effective seal is therefore necessary to prevent water from entering the mechanism.

Simple ring joints fitted in a groove inside the drill head are normally used for this purpose, adopting an "axial" or "central" system. Current experience shows that the life of these joints is very short and that they have to be replaced frequently.

According to the present invention there is provided a percussion drill comprising a sealing device in a fluid injection circuit between a fluid inlet tube and a drill rod, the sealing device comprising a sealing socket which is engageable at one end on an end of the fluid inlet tube and has a bore complementary in shape to said one end of the fluid inlet tube, the sealing socket having an outer metal casing locatable in a bore in the drill rod, and a resilient member which is secured in the casing and defines, at the other end of the socket, a flared part forming an annular lip which, when in a normal condition, has a diameter larger than the diameter of the bore of the drill rod.

Such a sealing device, which can be fitted onto the end of the tube simply by pushing it on by hand, operates entirely satisfactorily thus:

- when starting, the combined action of the pressure of the fluid and of the vibrations produced by the hammer upon impact ensures that the resilient member is firmly wedged onto the end of the tube;
- the outer metal casing prevents any excessive expansion and also serves to centre the sealing device; and
- the annular lip compressed against the bore of the drill rod provides the seal.

Preferably, the bore of the drill rod has a flared section to centre the sealing socket when the latter is positioned in the drill, and to compress the annular lip to the diameter of the bore of the drill rod.

Preferably also, the bore of the sealing socket is defined in the resilient member and is of truncated conical shape, opening onto said one end of the sealing socket.

Alternatively, the outer metal casing is extended beyond the resilient member at said one end of the sealing socket, and has an inner wall of truncated conical shape, the bore of the sealing socket being defined by said inner wall and by a bore of truncated conical shape in the resilient member, such that the area of engagement between the inlet tube and the sealing socket is partly metallic.

Preferably, the angle of opening of the bore of the resilient member is greater than the angle of opening of the inner wall of the metal casing.

BRIEF DESCRIPTION OF THE DRAWING

Embodiments of the present invention will now be described by way of example only with reference to the accompanying schematic drawings in which.

SPECIFIC DESCRIPTION

Figure 1:
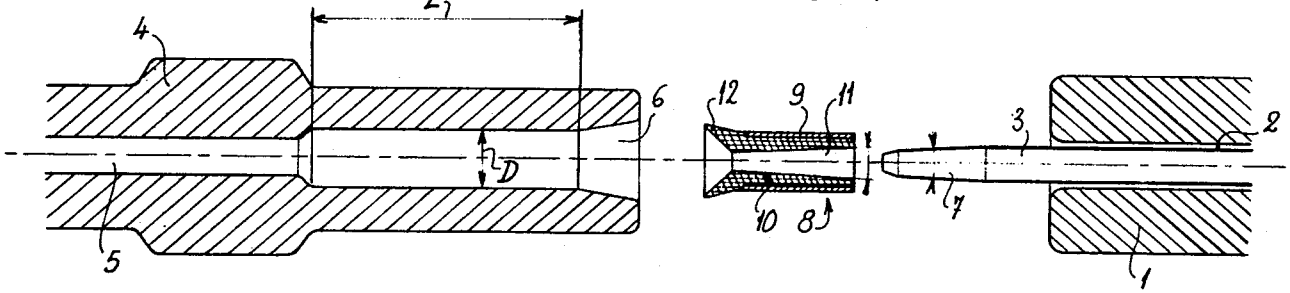
FIG. 1 is a longitudinal section showing various parts of one embodiment of a percussion drill according to the invention, before assembly.
Figure 2:
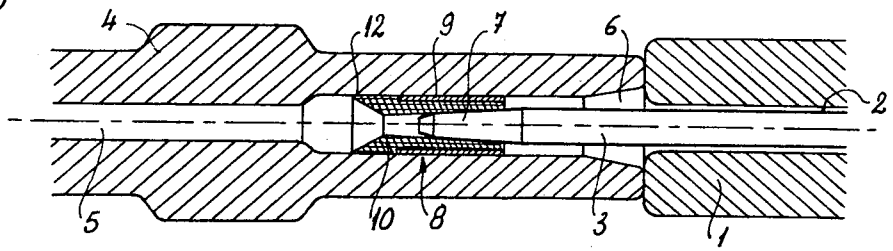
FIG. 2 is a longitudinal section of the drill parts shown in FIG. 1, but after assembly.
Figure 1A:
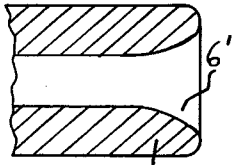
FIG. 1A shows a portion of the device of FIG. 1 with a modification.

A percussion drill, of which a section is shown in FIGS. 1 and 2, comprises a piston 1 arranged to strike against one end of a drill rod 4, a bore 2 being drilled axially through the piston 1 and being of sufficient diameter to accommodate a tube 3 which is rigidly connected to a hammer and permits fluid, e.g. water, to be admitted. The end of the drill rod 4, which penetrates into the drill and on which the impacts are exerted, is also drilled along its centerline to provide a bore 5 which is formed accurately to a dimension D over a certain length L, and over this length L its surface condition meets the normal requirements for a surface suitable for withstanding the sliding action of a fluid-tight packing. The inlet to the bore 5 has a flared section 6 which can be frustoconical (FIG. 1) or can have a curvilinear generatrix as shown at 6' in FIG. 1A.

When the drill is assembled, the tube 3, rigidly connected to the hammer, penetrates into the bore 5 of the drill rod 4. The tube 3 has a tapered end 7 which is obtained by normal machining, die-stamping or hammering, and which is accommodated inside the accurately drilled length L.

A sealing device in the form of a socket 8 is located between the tube 3 and the wall of the drill rod 4 with dimension D, around the tapered end 7. The socket 8 comprises a thin metal outer casing 9, the external diameter of which fits with little play into the bore 5 of the drill rod 4, and an elastomeric member 10 which occupies the space between the outer metal casing 9 and the tapered end 7 of tube 3. The elastomeric member 10 has a central passage 11 of truncated conical shape the angle of opening $\alpha$ of which corresponds to the angle of the tapered end 7. At the narrower end of the passage 11, the member 10 flares out to form a flexible annular lip 12 which, when the device is dismantled (FIG. 1), is of greater diameter than the dimension D.

Positioning is as follows: the socket 8 is pressed by hand onto the tube 3 and the drill rod 4 is inserted into the percussion drill. The flared section 6, obtained by machining the end of the bore 5, enables the socket 8 to be centered and the sealing lip 12 to close to the dimension D of the bore 5. Conversely, for dismantling the socket 8 is disconnected from the drill rod 4 and from the tube 3 simply by pushing.

In operation, the combined action of the pressure of the fluid and of the vibrations produced by the hammer at the moments of impact ensures that the female elastomeric member 10 fits tightly onto the tapered end 7 of the male metal tube 3. The metal outer casing 9 of the sealing device, i.e. socket 8, prevents any excessive expansion between the elastomeric member 10, which is firmly held between the tapered end 7 and the casing 9, and the flexible lip 12 then provides the seal.

Figure 3:
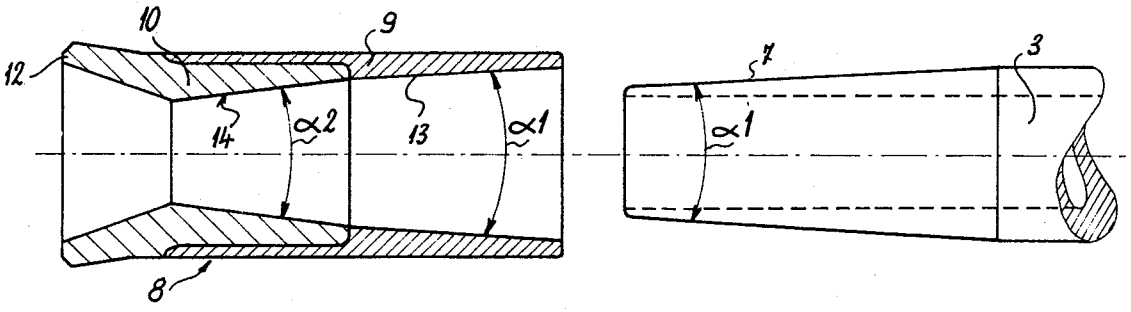
FIG. 3 is a partial section showing various parts of a second form of a percussion drill according to the invention, before assembly.
Figure 4:
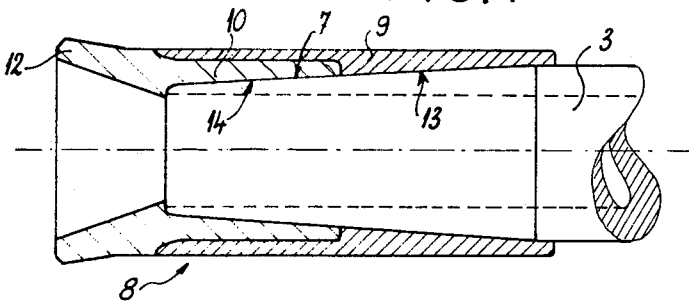
FIG. 4 shows the parts illustrated in FIG. 3, but after assembly.

In another embodiment illustrated in FIGS. 3 and 4, the outer metal casing 9 of the socket 8 extends beyond the end of the elastomeric member 10 at the end thereof adjacent to the tube 3, and is machined in such a way that a section 13 of the length of the socket is metallic, another section 14 comprising the wall of the central passage of the elastomeric member 10.

Thus when the vibrations are particularly severe the socket 8 can be positively prevented from moving over the tapered end 7 at the end of the fluid inlet tube 3 as a result of the two metal parts locking together, the seal being provided by the section 14. This section 14 has an opening angle $\alpha_2$ which is slightly larger than the opening angle $\alpha_1$ of the end 7, and which corresponds to the opening angle of the metallic section 13 such that as soon as the socket 8 is pressed into position on the tube 3 a seal is obtained.

The invention is not of course limited to the particular forms of execution of the sealing device described above as examples, but does in fact cover all variants of the idea.

I claim:

1. A percussion drill comprising a sealing device in a fluid injection circuit between a fluid inlet tube and a drill rod, the sealing device comprising a sealing socket which is engageable at one end on an end of the fluid inlet tube and has a bore complementary in shape to said one end of the fluid inlet tube, the sealing socket having an outer metal casing locatable in a bore in the drill rod, and a resilient member which is secured in the casing and defines, at the other end of the socket, a flared part forming an annular lip which, when in a normal condition, has a diameter larger than the diameter of the bore of the drill rod.

2. A drill according to claim 1, in which the bore of the drill rod has a flared section to center the sealing socket when the latter is positioned in the drill, and to compress the annular lip to the diameter of the bore of the drill rod.

3. A drill according to claim 2, in which the flared section is of truncated conical shape.

4. A drill according to claim 2, in which the flared section has a curvilinear generatrix.

5. A drill according to claim 1, in which the bore of the sealing socket is defined in the resilient member and is of truncated conical shape, opening onto said one end of the sealing socket.

6. A drill according to claim 1, in which the outer metal casing is extended beyond the resilient member at said one end of the sealing socket, and has an inner wall of truncated conical shape, the bore of the sealing socket being defined by said inner wall and by a bore of truncated conical shape in the resilient member, such that the area of engagement between the inlet tube and the sealing socket is partly metallic.

7. A drill according to claim 6, in which the angle of opening of the bore of the resilient member is greater than the angle of opening of the inner wall of the metal casing.

* * * * *